United States Patent [19]

Abbott-Davies

[11] 4,453,371

[45] Jun. 12, 1984

[54] HARNESS FOR A HORSE

[76] Inventor: Thomas P. A. Abbott-Davies, Le Presbytere, Villers St. Leu, Oise 60, France

[21] Appl. No.: 919,295

[22] Filed: Jun. 26, 1978

[30] Foreign Application Priority Data

Jul. 6, 1977 [GB] United Kingdom ..... 28295/77

[51] Int. Cl.[3] ..... B68B 1/00; B68B 5/04

[52] U.S. Cl. ..... 54/35; 54/71

[58] Field of Search ..... 54/34, 35, 71, 78, 1, 54/70, 15

[56] References Cited

U.S. PATENT DOCUMENTS

| | | | |
|---|---|---|---|
| 369,294 | 8/1887 | Moose | 54/71 |
| 710,267 | 9/1902 | Graf | 54/71 |
| 727,550 | 5/1903 | Minck | 54/71 |
| 2,763,111 | 9/1956 | Turner | 54/78 |

*Primary Examiner*—Hugh R. Chamblee

[57] ABSTRACT

A harness for a horse comprises leash means having a first portion and a second portion, (a) said first portion being forked to provide first and second side leashes each having end portions, (b) and second portion being a portion selected from the alternative portions: (i) a portion positionable under said horse and fastenable to the horse's tail, (ii) a portion positionable under said horse and fastenable to a girth for said horse, and (iii) a portion positionable at a front portion of said horse and fastenable to means carried by that front portion; first support means fastenable to bridle means such that said first side leash will be supported by said first support means so as to be running movable relative to said bridle means; and second support means fastenable to said bridle means such that said second side leash will be supported by said second support means so as to be running movable relative to said bridle means.

8 Claims, 3 Drawing Figures

HARNESS FOR A HORSE

FIELD OF THE INVENTION

The invention relates to a harness for a horse, and more particularly to a harness for training a horse to maintain correct balance and head position. In this specification and its appended claims, the term "horse" is used generically and includes ponies.

BACKGROUND OF THE INVENTION AND PRIOR ART

It is known that it can be difficult and time consuming to train horses, for example in regard to attempting to train a horse to acquire correct balance, for instance regarding controlling raising of a horse's head.

A first known harness for controlling raising of a horse's head is a harness called a "standing martingale". This comprises a leash having first and second end portions. The first end portion has a terminal loop through which a headband of bridle means will pass. The second end portion is positionable under the horse and has a terminal loop through which a girth will pass. A neckstrap can support the leash, so as to prevent the leash hanging too low. The standing martingale is independent of the reins to the horse's head. A second known harness for controlling raising of a horse's head is a harness called a "running martingale". This comprises a leash having first and second end portions. The first end portion is forked to provide first and second side leashes, each of which terminate in a respective ring through which a corresponding rein will pass so as to enable the ring to run along the rein. The second end portion, which is unforked, is positionable under the horse and has a terminal loop through which a girth will pass. A neckstrap can support the second end portion to prevent that portion hanging too low.

An object of the present invention is to provide a harness that can be used to provide improved training of a horse, for example regarding balance of the horse, behaviour of the horse, and accelerated training of the horse.

Another object of the present invention is to provide a harness which can be used with a snaffle bit.

SUMMARY OF THE INVENTION

According to the present invention, there is provided a harness for a horse, comprising leash means having a first portion and a second portion, (a) said first portion being forked to provide first and second side leashes each having end portions, (b) said second portion being a portion selected from the alternative portions: (i) a portion positionable under said horse and fastenable to the horse's tail, (ii) a portion positionable under said horse and fastenable to a girth for said horse, and (iii) a portion positionable at a front portion of said horse and fastenable to means carried by that front portion; first support means fastenable to bridle means such that said first side leash will be supported by said first support means so as to be running movable relative to said bridle means; and second support means fastenable to said bridle means such that said second side leash will be supported by said second support means so as to be running movable relative to said bridle means.

It is to be understood that a said harness of the present invention can be modified so as to change one embodiment of said harness into another embodiment of said harness, for example to convert said possibility (i) into said possibility (ii) for said second portion of said harness. Thus, for example said second portion of said harness can comprise a terminal rope for being hitched to the horse's tail, the rope being fastened to a loop comprised by said second portion, said loop being able to have a girth passed through it so that when said rope is detached from said loop, said loop can have a girth passed through it. It will be appreciated then that a said harness of the present invention could be conveniently provided as a kit of unassembled or partly assembled parts. If desired, first and second reins, or other reins or other tack, can also be included in a said harness of the present invention.

DESCRIPTION OF THE DRAWINGS

In the accompanying drawings, which are given by way of example and are not intended to limit the scope of the present invention.

DETAILED DESCRIPTION OF THE INVENTION

Figure 1:
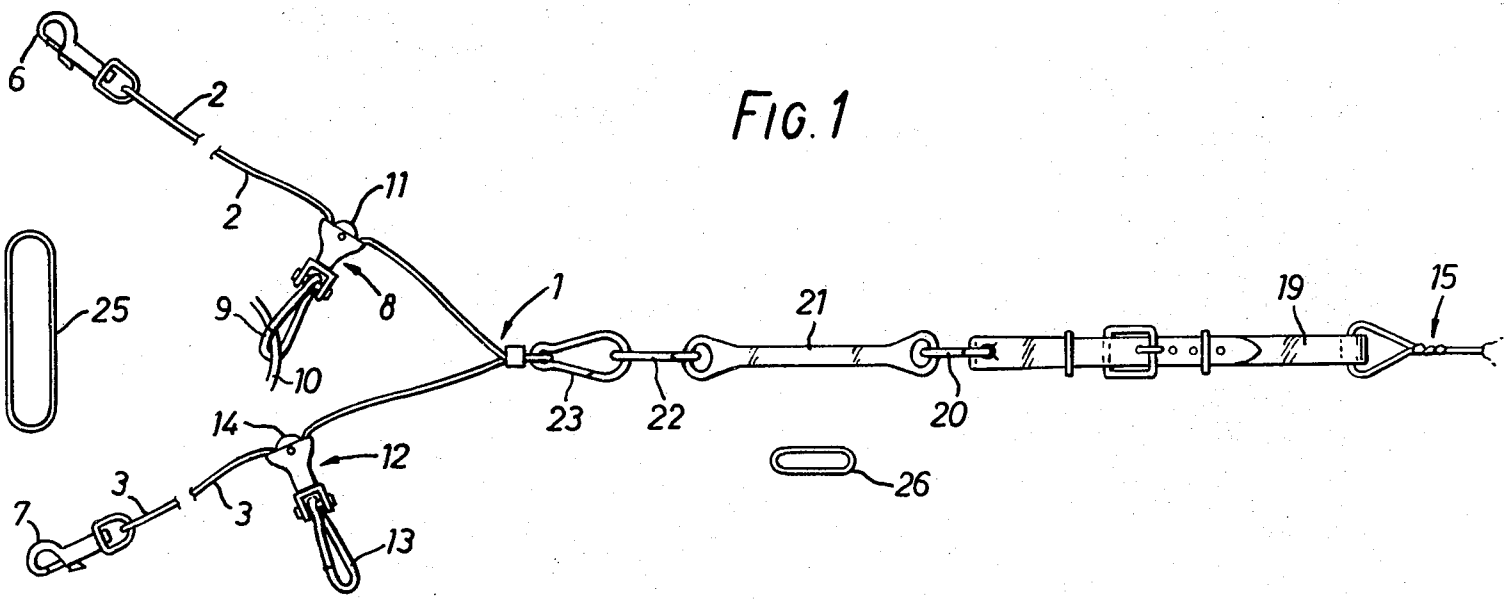
FIG. 1 shows one embodiment of a harness of the present invention, this embodiment being convertible into other harnesses of the present invention.
Figure 2:
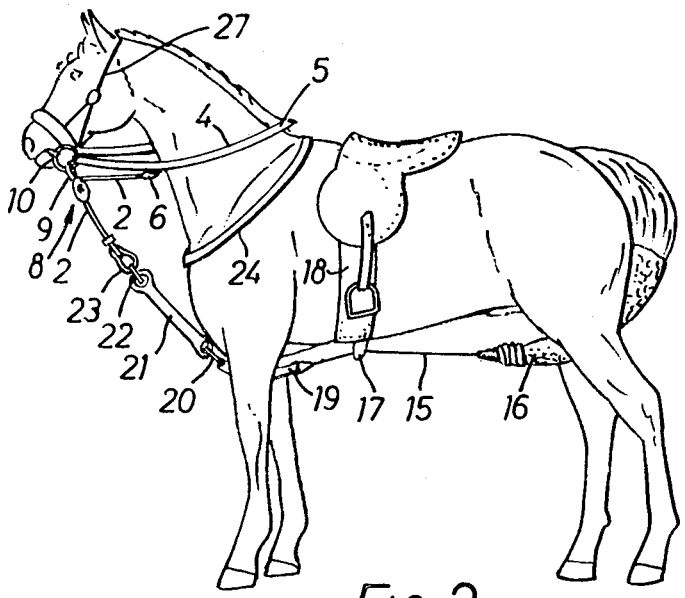
FIG. 2 shows a harness of FIG. 1 on a horse.

In FIG. 1, a harness for a horse comprises a leather first end leash portion 1 forked to provide a first side leash 2 and a second side leash 3, respectively fastenable to a first rein 4 and a second rein 5. FIG. 2 shows the fastening of side leash 2 to rein 4 but does not show the fastening of side leash 3 to rein 5; because, for the purpose of FIG. 2, said fastening to rein 5 is identical to said fastening to rein 4. For the purpose of its said fastening, side leash 2 has a terminal swivel stainless steel releasable fastener 6 for being fastened to a loop or D-ring (not shown) fixedly arranged on the inside of rein 4. Side leash 3 has a terminal swivel stainless steel releasable fastener 7 for being fastened to a loop or D-ring (not shown) fixedly arranged on the inside of rein 5. It will be appreciated that when reins 4 and 5 are pulled, those reins will pull side leashes 2 and 3 which are fastened thereto. This is e.g. utilized in modifications A and B discussed later below for said harness.

The side leashes 2 and 3 are supportable by bridle means 27 so as to be freely movable relative to said bridle means. For this purpose, a first support means 8 on side leash 2 is fastenable to a swivel stainless steel releasable fastener 9 to a snaffle ring 10 (see FIG. 2). The first support means 8 contains a pulley wheel 11 in running cooperation with side leash 2, so that side leash 2 can more freely through first support means 8. A second support means 12 on side leash 3 is fastenable by a swivel stainless steel releasable fastener 13 to a snaffle ring (not shown) on the opposite side to snaffle ring 10. The second support means 12 contains a pulley wheel 14 in running cooperation with side leash 3, so that side leash 3 can move freely through second support means 12. It will be appreciated from the discussion herein that the fastening of first support means 8 to snaffle ring 10 and the fastening of second support means 12 to the other snaffle ring enable desired angles of pull to be exerted on the bridle means 27 by the side leashes 2 and 3, whereby pull can be transmitted to the horse's mouth.

The harness of FIG. 1 comprises a rope 15 releasably hitchable to the horse's tail (see FIG. 2, and the discussion later below of modification A of the harness). An intervening portion of sheepskin 16 can be placed between the tail and the hitch. An optional eye 17 mounted under and to the girth 18 supports the rope 15 in running cooperation. The rope 15 represents the or part of a second end leash portion of the harness of FIG. 1. One end of the rope 15 is hitched to a looped end of an adjustable leather strap 19. A releasable stainless steel fastener 20 passes through the opposite looped end of strap 19, and through an eye in an enlarged end of a rubber link 21. The opposite enlarged end of link 21 has an eye through which passes a releasable stainless steel fastener 22. A releasable stainless steel fastener 23 passes through fastener 22 and through a loop provided at the fork in leash portion 1.

In FIG. 2, the side leashes 2 and 3 are supported by the bridle means 27. It will be appreciated, however, that any suitable bridle means could be used for this purpose, e.g. of the type shown generally at *27a* in FIG. 3.

Thus, the harness of FIG. 1 can provide a connection between the reins, the snaffle rings, and the tail of the horse. When the horse lifts its head so that the rubber link 21 undergoes resilient extension, the rubber link 21 will urge the horse's head to return to a lower position. Furthermore, the rubber link 21 can act as a shock absorber against e.g. tugging exerted on the tail. If these advantages provided by the rubber link 21 are not required, the rubber link 21 and fastener 22 can be omitted, fastener 20 then being fastened directly to fastener 23, or if fastener 20 is omitted fastener 23 can be fastened directly to strap 19. However, it will be appreciated from the discussion given later below of modification A that the rubber link 21 is used in modification A. When the rope 15, strap 19, fastener 20, rubber link 21 are omitted, the fastener 22 or fastener 23 can be fastened by a rubber ring 26 to girth 18, as described later below in modification D.

If desired, rope 15 can be detached from strap 19. The resultant free terminal loop in strap 19 can have the girth 18 passed through it, so as to fasten strap 19 thereto—see modification B discussed later below.

If desired, the strap 19 can be detached from fastener 20, which fastener can then be fastened to a neckstrap 24 (see FIG. 2) or a breastplate (not shown), by a ring (not shown).

Figure 3:
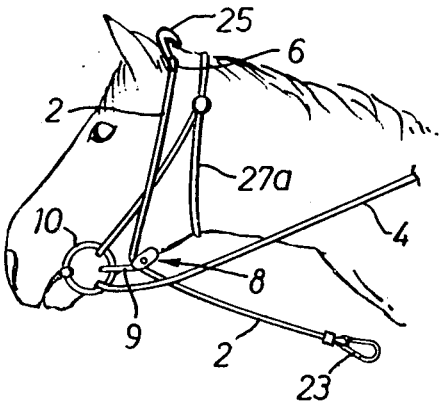
FIG. 3 shows an alternative way of mounting a portion of the harness of FIG. 1 to the horse's head.

As an alternative to fasteners 6 and 7 being fastened to the reins 4 and 5, the end portions of side leashes 2 and 3 above first and second support means 8 and 12 (see later below) can lead respectively up the sides of the horse's head and fasteners 6 and 7 be fastened to a rubber loop 25 positioned between the horse's ears. This way of fastening is shown in FIG. 3 and is utilized in modification C discussed later below for said harness.

It will be appreciated from rubber link 21, rubber loop 25 or rubber ring 26, that in a harness of the present invention there can be resilient extension means arranged for allowing resilient extension in said harness. Such means can be a single means or a plurality of means. A resilient extension means can be arranged at any suitable position or positions in said harness. Preferably, a said resilient extension means is arranged as an intermediate member in said leash means. For example, the resilient extension means can be arranged as an intermediate member in said second portion of said leash means. Any said resilient extension means in a said harness of the present invention can have any suitable form and be of any suitable construction. For example, a said resilient extension means can comprise a reel capable of unwinding therefrom a portion of leash when a pull is exerted on said portion, and exerting a tension on said unwound portion of leash so as to tend to rewind that portion onto said reel. Another example of resilient extension means comprises spring means. Preferably, a said resilient extension means comprises elastomeric extension means. Such elastomeric extension means can comprise an elastomeric member. This member can have any suitable form. For example, the elastomeric member can have a dogbone appearance; i.e. the member can have terminal enlarged portions for incorporating it into the harness, and have a bight portion bridging those terminal enlarged portions. Each of those enlarged portions can have an eye through which a harness component can be passed to incorporate said member into said harness. Another example of an elastomeric member is an elastomeric ring.

Where a fastening has to be made, this can be provided in any suitable way. Any one or more suitable fastener means can be utilized in a said harness of the present invention. In this respect, it will be appreciated that many different kinds of fastener are well known, e.g. stainless steel releasable fasteners. One kind of preferred fastener is a releasable stainless steel fastener, for instance one that can swivel.

If desired, where a harness of the present invention is attached to a horse's tail, protective material can be present between the tail and the harness. For example, a portion of sheepskin can be present between the tail and a hitched rope belonging to a said harness of the present invention.

The dimensions of the components of a said harness of the present invention will be chosen according to the way the harness is to be used.

Any suitable material can be used in leash portions of a harness of the present invention. Any suitable coverings, facings or protective material can be used with a harness of the present invention.

A said harness of the present invention can act as an accelerator in training, doing in a short time (e.g. a week) what would otherwise take several months.

In working with a said harness of the present invention, the horse may be overbent, but once the muscles are strengthened, the horse's head will be in the right position when said harness is not used. It is sometimes useful to progress from a said harness of the present invention to a running martingale.

It will be appreciated from the above description of the accompanying drawings that a said harness of the present invention can be modified. Examples of some convenient modifications are as follows. The strap 19 could be omitted, and the rope 15 hitched to fastener 20. The fastener 20 could be omitted, and the strap 19 looped through the adjacent eye of rubber link 21. If the strap 19 and fastener 20 are omitted, the rope 15 could be hitched to said eye of the rubber link 21. If the rubber link 21 is omitted, the fastener 20 could be fastened to fastener 22, or fastener 23 if fastener 22 is omitted. If the fasteners 20 and 22 and the rubber link 21 were omitted, the strap 19 could be looped through fastener 23. If desired, the rope 15 could be directly hitched to fastener 23. If desired, fastener 23 could be replaced by a ring.

USE OF THE INVENTION

The following is a discussion of examples of various ways of using a harness of FIG. 1. These ways are referred to below as modifications A, B, C and D. For all of these modifications, a horse is made to work muscles that may be lazy. Therefore, after the first day's use of any of modifications A, B, C and D the horse may be a little stiff. However, use of the harness should be continued. The harness should not be used if the horse is in any way malformed, sick or pregnant.

Modification A

In the description of FIG. 1, it is stated that the rope 15 can be hitched to the horse's tail, using an intervening portion of sheepskin 16. The description of FIG. 1 also states that the terminal fasteners 6 and 7 can be fastened to the reins 4 and 5. This fastening and the fastening of the rope 15 to the horse's tail constitute modification A, which is shown as such in FIG. 2.

Modification A will result in the horse standing with his head low and looking restricted, but this is because he is pulling his tail and lowering his head. He will balance up when on the move. The first time the horse is subjected to modification A, the horse should be walked gently, e.g. backwards. The horse should then be walked around for e.g. 5 minutes, including giving him e.g. some sugar to help him mouth and associate sugar with a feeling of correct balance. When the rider is mounted and the horse moves forward, the horse's tail goes down and the horse's head comes up a little. It is recommended that modification A should be used only about ½ hour. As a general matter of using modification A, the horse's quarters come up tight underneath him, and his front comes into the rider's hands, giving a pleasant sensation and comfortable armchair canter. Experience has shown that for modification A, a horse becomes extremely docile. In this respect, the horse can be handled with fingers rather than hands, so far as the reins are concerned. If a collected canter is carried out in a small circle on what is normally the horse's bad side, the results can be advantageous. It is recommended to use modification A to start with, and then go onto modification B (see below) for every day use.

Modification B

In the description of FIG. 1, it is stated that the strap 19 can have the girth 18 passed through it, so as to fasten strap 19 thereto. The description of FIG. 1 also states that the terminal fasteners 6 and 7 can be fastened to the reins 4 and 5. This fastening and the fastening of strap 19 to girth 18 constitute modification B.

Modification B can be used every day, e.g. for exercising, working on the flat, or jumping. Modification B is recommended for jumping up to 3 feet 6 inches (1.08 meters approximately). Modification B used every day will enable the horse to develop muscles that will eventually keep the horse properly balanced when the harness is removed, i.e. the horse will then flex his head and neck correctly. Modification B will rapidly strengthen the horse's back muscles, sometimes bringing up a low back as much as 2 inches (approximately 5 cms.). This has been very noticable for race horses. During riding, the rider's hands should in holding the reins be very mobile, firm, and gentle, so that the snaffle rings are played with, side to side, backwards and forwards, tension being released on the snaffle rings when the horse puts his head down. Full use should be made of e.g. backing the horse and coming forward at once, and passage. The harness will be very rewarding at a collected canter turning small circles. When jumping, the horse will automatically try to stretch his neck before taking off. This stretching should not be prevented by the rider. Modification B is recommended when jumping cavaletties, and with the last cavaletti at double height. During jumping with modification B, the horse will eventually begin to bascule, using his head and neck as a counter balance. An aim in a show ring or in tight situations in cross-country eventing is to be able to bring the horse together quickly and without fuss, especially without fuss, so as to be settled for the next jump. Modification B will assist that aim, e.g. when a horse has been taught to turn by pressure applied to the horse from a leg of the rider. Another aim is to have the horse react well, with only an ordinary rein and a snaffle bit fitted for all riding variations and conditions. Modification B will assist that aim. Modification B can be used in warming up the horse, before going into e.g. a dressage ring, modification B being taken off at the last moment.

Modification C

In the description of FIG. 1, it is stated that the strap 19 can have the girth 18 passed through it, so as to fasten strap 19 thereto. The description of FIG. 1 also states that the end portion of side leashes 2 and 3 can lead up the sides of the horse's head (see FIG. 3), so that those end portions can be fastened to a rubber loop 25 positioned on the horse's head between the horse's ears. This fastening and the fastening of strap 19 to girth 18 constitute modification C.

Modification C is mainly used for lunging, but can also be used when the horse is ridden, e.g. in exercising. After e.g. 10 minutes work using modification C, the horse will lower his head and neck in an exaggerated way that will exercise his neck and back muscles.

Modification D

A further modification D, especially suitable for use on a pony, is to omit rope 15, strap 19, fastener 20, rubber link 21, and then fasten fastener 22 to a rubber ring 26 (see FIG. 1) to a girth 18. If desired, fastener 22 could be omitted, in which case fastener 23 could be fastened to rubber ring 26.

It will be appreciated that ponies are small, often never schooled or made to behave by adults; and children are often not strong enough or experienced enough to cope with horses. Modifications A, B, C and D are advantageous in dealing with those problems. Modifications A, B, C and D (conveniently modification D) can often allow children to school their own ponies with ease under direction from an adult. Indeed, modifications A, B, C and D can help children's keeness and produce happy results, giving the children great encouragement. It has been found that children often can ride big horses fitted with modification A, B, C or D, and manage the horses well.

Some options for embodying a said harness of the present invention are disclosed in the subclaims appended to this specification. The disclosures of all of said subclaims are incorporated by reference into the body of this specification, in order to emphasise that these options also form part of this description.

What is claimed is:

1. A training harness for a horse comprising: a first portion forked at one end to provide first and second side leashes, each leash being adapted to be connected at its end opposite said forked end to a respective rein of a bridle means, each side leash being movably supported by respective means adapted to be swivelably connected to a bit assembly of a bridle means; and a second portion comprising linear means connected at one end thereof to the forked end of said first portion, the other end of said second portion being adapted for connection to an element carried by the forequarters of a horse.

2. A training harness for a horse comprising: a first portion forked at one end to provide first and second side leashes, each leash being adapted to be connected at its end opposite said forked end to a respective rein of a bridle means, each side leash being movably supported by respective means adapted to be swivelably connected to a bit assembly of a bridle means; and a second portion comprising linear means connected at one end thereof to the forked end of said first portion, the other end of said second portion passing under at least a portion of the body of a horse and being adapted to be connected to a girth around the body of a horse.

3. A training harness for a horse comprising: a first portion forked at one end to provide first and second side leashes, each leash being adapted to be connected at its end opposite said forked end to a respective rein of a bridle means, each side leash being movable supported by respective means adapted to be swivelably connected to a bit assembly of a bridle means; and a second portion comprising linear means connected at one end thereof to the forked end of said first portion, the other end of said second portion passing under at least a portion of the body of a horse and being adapted to be connected to the tail.

4. A harness as claimed in claim 1 or 2 or 3 wherein each said support means comprises pulley means in running cooperation with each side leash.

5. A harness as claimed in claim 1 or 2 or 3 wherein said ends of said side leashes are fastened together over the top of the horse's head.

6. A harness as cleimed in claim 1 or 2 or 3 wherein said ends of said side leashes are fastened to a resilient means on the top of the horse's head.

7. A harness as claimed in claim 1 or 2 or 3 further comprising resilient extension means in said harness.

8. The training harness according to claim 1 or 2 or 3 wherein said linear means comprises at least one element selected from the group consisting of a resilient, elongated element of predetermined length, an element whose length can be adjusted according to the length of a horse's body, a rope-like element connectable at one end to one of said foregoing elements and having a cushioned element attached to the opposite end of said rope-like element, a resilient ring element, releasable interlock members to interconnect said elements and releasable means to connect said first portion releasable means to said one end of said linear means.

* * * * *